United States Patent [19]

Gibson et al.

[11] Patent Number: 4,528,965

[45] Date of Patent: Jul. 16, 1985

[54] ROTOR BALANCING FOR DISTRIBUTION VALVE

[75] Inventors: Dennis H. Gibson, Edelstein; Ronald D. Shinogle, Peoria; Alan R. Stockner, Chillicothe, all of Ill.

[73] Assignee: Caterpillar Tractor Co., Peoria, Ill.

[21] Appl. No.: 593,983

[22] Filed: Mar. 27, 1984

[51] Int. Cl.[3] ..... F02M 59/38

[52] U.S. Cl. ..... 123/502; 417/494

[58] Field of Search ..... 123/500, 450, 503, 502, 123/374, 364, 372, 501; 417/270, 517, 494

[56] References Cited

U.S. PATENT DOCUMENTS

| | | | |
|---|---|---|---|
| 1,706,785 | 3/1926 | Junkers | 417/494 |
| 2,050,134 | 8/1936 | Thomas | 417/494 |
| 2,145,640 | 1/1939 | Alden | 123/500 |
| 2,880,756 | 4/1959 | Puls | 137/625.23 |
| 3,004,555 | 10/1961 | Haberland | 137/625.68 |
| 3,067,979 | 12/1962 | Cox | 251/282 |
| 3,427,979 | 2/1969 | Kemp | 123/450 |
| 3,509,823 | 5/1970 | Kemp et al. | 123/450 |
| 4,165,725 | 8/1979 | George et al. | 123/450 |

*Primary Examiner*—Craig R. Feinberg

*Assistant Examiner*—David A. Okonsky

*Attorney, Agent, or Firm*—J. W. Burrows

[57] ABSTRACT

A rotor balancing arrangement is provided for use in a distribution valve to ensure hydrostatic balancing of a rotor located in the distribution valve. Some balancing arrangements provide areas equally spaced around the peripheral surface, each being exposed to the same pressure, however, they are limited to valves which rotate only through a limited arc of rotation. Other valves which rotate provide balancing grooves around portions of the peripheral surface but do not provide any control for the pressure that migrates axially in both directions along the peripheral surface of the rotor. In the subject arrangement, pressure fields of a predetermined size are located on a peripheral surface of a rotor circumscribing first and second outlet ports which open to opposite sides of the rotor. The size of the pressure fields is determined by the relationship of the diametrical clearance between the rotor and a bore with respect to the operating pressure of the system. This arrangement ensures that the differential forces acting on opposite sides of the rotor are minimized thus eliminating rotor sticking.

14 Claims, 8 Drawing Figures

ROTOR BALANCING FOR DISTRIBUTION VALVE

DESCRIPTION

1. Technical Field

This invention relates generally to a distributor valve and more particularly to balancing the rotor in the distributor valve.

2. Background Art

Distributor valves for use in the distribution of fluid, such as fuel for diesel engines, are generally intended to control the fuel delivered to the respective cylinders. The rotor used in these valves normally rotate relative to the engine speed and utilize various forms of balance grooves to aid in eliminating rotor "sticking". Rotor "sticking" is a result of differential forces acting on the periphery of the rotor causing breakdown of a fluid film between the rotor and its bore. The metal to metal contact results in "sticking" or seizure of the rotor in the bore.

One typical balancing arrangement provides equal pressure to areas equally spaced around the periphery of the spool or rotor. This arrangement is normally used on linear spool valves or on rotary valves which rotate only through a limited arc of rotation. These arrangements would have the problem of unwanted interconnection between ports in the rotor and the valve body during rotor rotation. Consequently, any attempts to balance the rotor must consider the rotation of the rotor.

Other arrangements provide annular grooves partially encircling the rotor in order to maintain low pressure on the periphery of the rotor adjacent the area of high pressure. However, these arrangements do not provide any control of the pressure on the periphery of the rotor which migrates axially in both directions along the rotor. Any eccentricity of the rotor in its bore allows a larger pressure field on one side of the rotor than on the other side, thus inducing a large differential force from one side of the rotor to the other side. Once the differential force reaches a magnitude sufficient to breakdown the fluid film on one side of the rotor, metal to metal contact occurs. This metal to metal contact causes rotor sticking.

The present invention is directed to overcoming one or more of the problems as set forth above.

DISCLOSURE OF THE INVENTION

In one aspect of the present invention, a distribution valve is provided having a housing defining a bore and a plurality of distributor passages in communication with the bore. A rotor is located in the bore and is adapted to rotate. The rotor has a peripheral surface and an axial passage located in the rotor and adapted for communication with a source of pressurized fluid. A pair of outlet ports is located in the rotor and is in continuous communication with the axial passage and opens to the peripheral surface of the rotor on opposite sides thereof. The outlet ports are also adapted for selective communication with the distributor passages located in the valve housing. A means is provided for establishing pressure fields of a predetermined size relative to the diametrical clearance between the rotor and bore with respect to the normal operating pressure of the system so that a differential force acting to cause eccentricity of the rotor in the bore is minimized thus eliminating rotor sticking. The pressure fields are disposed on opposite sides of the rotor and circumscribe each of the outlet ports.

The present invention provides a balanced rotor for use in a distribution valve. Pressure fields on opposite sides of the rotor control the differential forces acting on the rotor. These differential forces are a result of the pressurized fluid being subjected to the clearance between the rotor and the bore as the pressurized fluid passes from the outlet ports in the rotor to the distributor passages in the housing. By controlling the size of the pressure fields on the peripheral surface of the rotor relative to the diametrical clearance between the rotor and the bore with respect to the operating pressure, the differential forces acting on opposite sides of the rotor can be held to a minimum value.

BEST MODE FOR CARRYING OUT THE INVENTION

Figure 1:
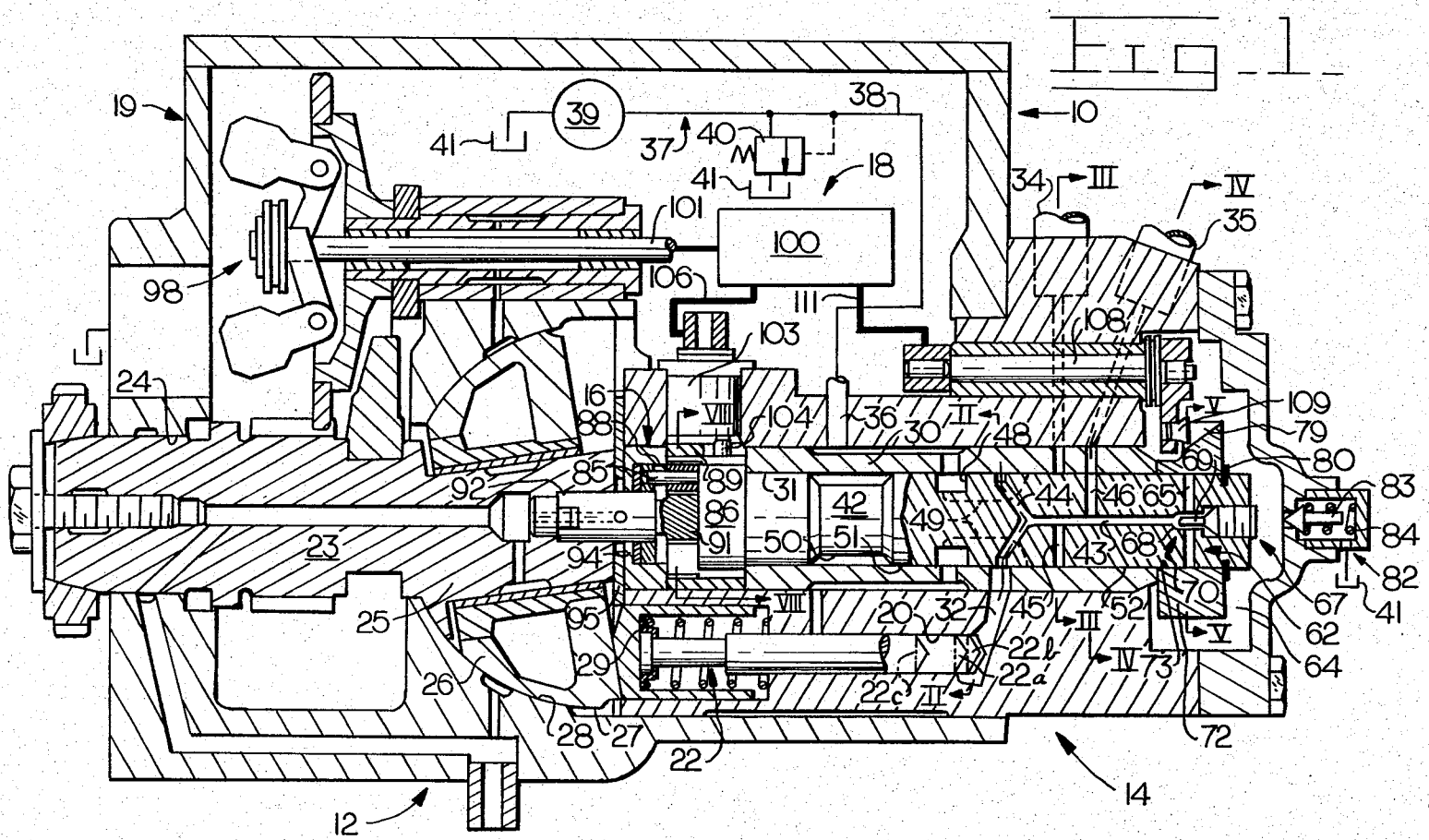
FIG. 1 is a partial schematic and sectional view of an embodiment of the present invention.
Figure 2:
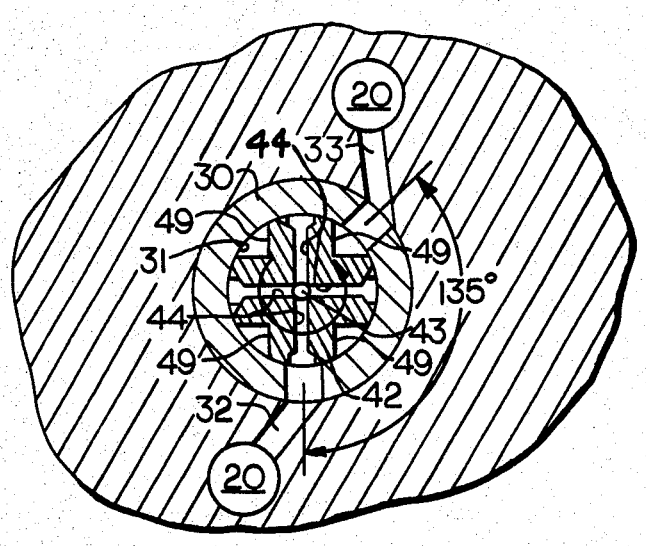
FIG. 2 is a somewhat enlarged view taken along the line II—II of FIG. 1.

Referring now to FIG. 1, a fuel injection system is generally indicated by the reference numeral 10 and includes a source of pressurized fluid, such as, a pumping section 12, a distribution valve 14, a planetary gear arrangement 16 driven by the pumping section 12 and drivingly connected to the distribution valve 14, and a governor section 18 all contained within a common multipiece housing assembly 19.

The pumping section 12 is of the nutating type and includes a pair of pumping chambers 20 (only one of which is shown in FIG. 1) defined in the housing assembly 19, and a pair of plunger assemblies 22 (only one of which is shown in FIG. 1) each reciprocatably disposed in the respecting pumping chamber 20. The plunger assembly 22 as shown in FIG. 1 is illustrated in three different operating positions *22a,22b,22c*. The pumping section 12 also includes a drive shaft 23 suitably journalled within a bore 24 of the housing assembly 19. An angled eccentric portion 25 is formed on the drive shaft 23 and has a nutating member 26 journalled on the eccentric portion 25. The nutating member 26 has a spherical surface 27 seated in a mating concave spherical bearing surface 28 defined by the housing assembly 19. A spring 29 resiliently urges each of the plunger assemblies 22 into intimate contact with the nutating member 26.

Referring now to FIGS. 2–7 in conjunction with FIG. 1, the distribution valve 14 includes a sleeve 30 rigidly disposed in the housing assembly 19 and defining a bore 31. First and second delivery passages 32,33 respectively communicate the pumping chambers 20 with the bore 31. The delivery passages 32,33 communicate with the bore 31 at points arcuately spaced 135° apart. A first and second plurality of distributor passages 34,35 communicate with the bore 31 in separate axially spaced planes and are connectable to the cylinder combustion chambers of an engine (not shown) in the usual manner. A passageway 36 (FIGS. 1 and 6) communicates with the bore 31 and is connected to a low pressure zone 37 by a conduit 38. The low pressure zone 37 includes, for example, a fuel transfer pump 39, a relief valve 40, and a fuel tank 41.

A rotor 42 is rotatably positioned within the bore 31 and has an axial passage 43 selectively communicatable with the first and second delivery passages 32,33 through a plurality of inlet ports 44 in a predetermined timed pattern. A pair of outlet ports 45,46 in the rotor 42 selectively communicates the axial passage 43 with the respective first and second plurality of distributor passages 34,35.

A first annular groove 48 formed in the rotor 42 is in continuous communication with the passageway 36 of the housing assembly 19. A plurality of axial slots 49 formed in the distributor rotor 42 selectively communicate the first annular groove 48 with the first and second delivery passages 32,33. A second annular groove 50 is formed in the rotor 42 and is axially spaced on the rotor 42 from the first annular groove 48 in a direction opposite to that of the first and second outlet ports 45,46. A land 51 is defined on the rotor 42 between the first and second annular grooves 48,50.

Figure 7:
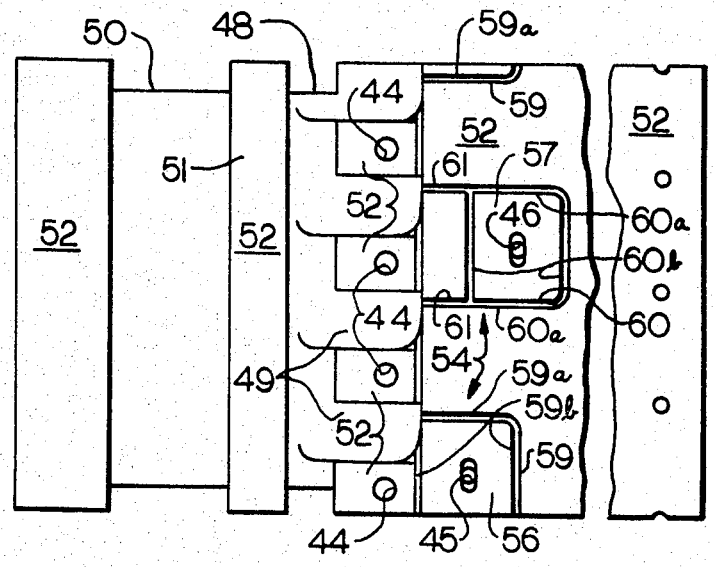
FIG. 7 is a developed view of the rotor shown in FIG. 1.

The rotor 42 has a peripheral surface 52 extending along its entire length as more clearly shown in FIG. 7. A means 54 is provided on the surface 52 for establishing pressure fields of a predetermined size relative to a diametrical clearance between the rotor 42 and the bore 31 with respect to a normal operating pressure of the pumping section 12 so that a differential force acting to cause eccentricity of the rotor 42 in the bore 31 is minimized. The establishing means 54 includes first and second pressure fields 56,57 each being respectively disposed on opposite sides of the rotor and circumscribing the respective outlet ports 45,46. The establishing means 54 further includes first and second grooves 59,60 formed on the periphery of the rotor and circumscribing the respective outlet ports 45,46 thus establishing the predetermined size of the pressure fields 56,57. The grooves 59,60 are connected to the first annular groove 48 by the plurality of slots 49. Each of the grooves 59,60 has two sets of parallel sides **59*a-b*,60*a-b*. One set 59*a*,60*a* of the two sets of parallel sides of each pressure field 56,57 extends axially on the peripheral surface 52. The other set 59*b*,60*b* of the two sets of parallel sides of each pressure field 56,67 is located circumferentially around the peripheral surface 52. One side of each of the other sets 59*b*,60*b* is diametrically opposed to the respective outlet port 46,45. As illustrated in FIG. 7 the groove 59 is interrupted by one of the plurality of slots 49 while extension grooves 61 connect the second groove 60 to the axial slots 49**.

Figure 5:
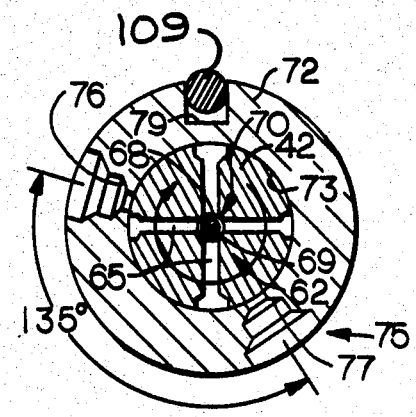
FIG. 5 is a somewhat enlarged view taken along line V—V of FIG. 1.
Figure 8:
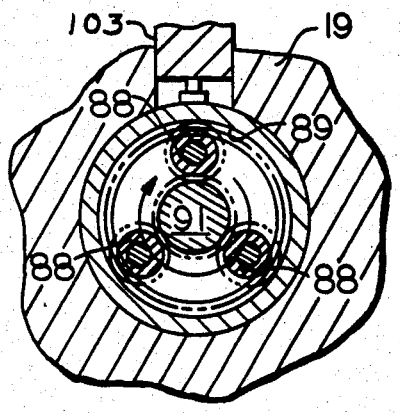
FIG. 8 is a somewhat enlarged view taken along line VIII—VIII of FIG. 1.

A bypass port means 62 is provided in the rotor for communicating the axial passage 43 to a low pressure chamber 64 in the housing assembly 19. The bypass port means 62 includes a bypass port 65 communicating the axial passage 43 with the peripheral surface 52. As shown in FIG. 5, the bypass port 65 includes two cross drilled holes opening to the peripheral surface 52 of the rotor 42 at four equally spaced points.

A means 67 is provided in the rotor for restricting the flow of fluid from the axial passage 43 to the low pressure chamber 64. The restricting means 67 includes an opening 68 of a predetermined cross-sectional area located in the bypass port 65 and a member 69 of a smaller predetermined cross-sectional area disposed in the opening 68 to establish a fixed orifice 70 of a predetermined size.

A bypass collar 72 defining a bore 73 is disposed about a portion of the rotor 42 and adapted to allow relative rotation between the rotor 42 and the collar 72. As more clearly shown in FIG. 5, spill passage means 75 is provided for selectively communicating the bypass port means 62 of the rotor 42 with a low pressure chamber 64. The spill passage means 75 includes first and second spill passages 76,77 communicating the bore 73 of the collar 72 with the low pressure chamber 64. The spill passages 76,77 communicate with the bore 73 at points arcuately spaced 135° apart. The collar 72 further defines a slot 79 therein opening to the peripheral surface of the collar 72. The collar 72 is axially retained on the rotor 42 between a portion of the housing assembly 19 and a lock ring 80.

A means 82 is provided for controlling the pressure level of the fluid in the low pressure chamber 64. The controlling means 82 includes a relief valve poppet 83 located between the low pressure chamber 64 and the fuel tank 41. A spring 84 biases the poppet 83 closed in a conventional manner.

The planetary gear arrangement 16 includes a plurality of carrier pins 85 connected to and extending axially from an end portion 86 of the rotor 42. Each of the carrier pins 85 rotatably carry a planet gear 88 which meshes with a ring gear 89 and a sun gear 91. The sun gear 91 is integrally connected to the drive shaft 23 by a shaft 92. The end of the carrier pins 85 extend to and support an annular thrust bearing assembly 94 which abuts a plate 95 suitably secured to the housing assembly 19.

The governing section 18 includes a flyweight assembly 98 responsive to the speed of the drive shaft 23 of the pumping section 12 and hence to the speed of the engine to which the fuel distribution system 10 is connected. A governor control 100 is operatively connected to the flyweight assembly 98 by a shaft 101.

A control shaft 103 has an eccentric projection 104 extending therefrom and in mating contact with the ring gear 89. The governor control 100 is operatively connected to the control shaft 103 by any suitable operating mechanism 106. A control shaft 108 has an eccentric projection 109 extending therefrom and in mating engagement with the slot 79 of the collar 72. A suitable operating mechanism 111 connects the output of the governor control 100 to the control shaft 108.

INDUSTRIAL APPLICABILITY

In the use of a fuel distribution system of this type, the pumping section 12 delivers fuel from the pumping chambers 20 to the respective delivery passage 32,33. As illustrated in FIG. 1, the pumping section 12 is a nutating pump. It is recognized that various forms of pumps could be used, however, the nutating pump offers compactness and the capability of producing operating system pressures well beyond 55,000 kPa (7,980 psi).

During rotation of the drive shaft 23, each of the plunger assemblies move within its respective pumping chamber 20. The postion **22*c* of the plunger 22** shown in FIG. 1 represents the postion at which the pumping chamber 20 is full of fuel. The postion 22*b* represents the position at which all of the fuel from the pumping chamber 20 has been expelled. The postion 22*a* generally represents the position of the plunger assembly 22 at one of the points when fuel is being directed to one of the cylinder combustion chambers. FIGS. 1–5 all represent the system during injection of fuel to one of the cylinder combustion chambers.

Figure 4:
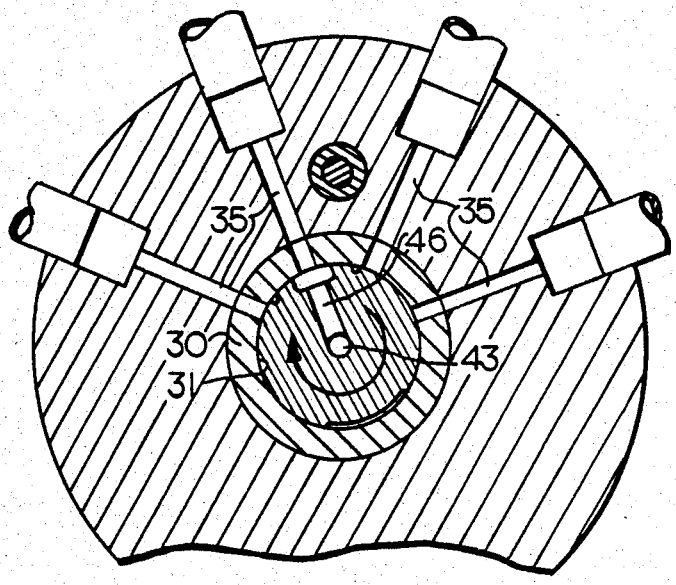
FIG. 4 is a somewhat enlarged view taken along line IV—IV of FIG. 1.
Figure 6:
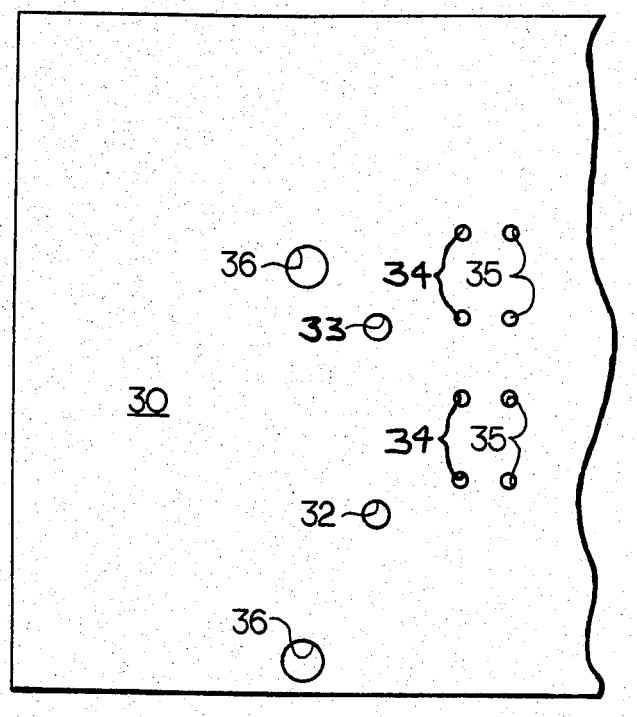
FIG. 6 is a developed view of a portion of the sleeve shown in FIG. 1.

The pressurized fluid in the delivery passage 32 enters one of the inlet ports 44 of the rotor 42 and communicates with the axial passage 43. The pressurized fluid from the axial passage 43 cooperates with the outlet port 46 and is injected into one of the cylinder combustion chambers (not shown) through the respective distributor passage 35 as shown in FIG. 4. At the illustrated position of the rotor 42, all of the pressurized fluid from the delivery passage 32 is being directed to the cylinder combustion chamber in the engine through one of the delivery passages 35.

From a review of FIG. 5, it is noted that additional rotation of the rotor 42 in the direction illustrated by the arrow results in the communication of the bypass port 65 with the spill passage 76. Since the bypass port 65 is in communication with the axial passage 43, the pressurized fluid in the axial passage 43 bypasses to the low pressure chamber 64 through the spill passage 76. The bypassed fuel in the low pressure chamber 64 is directed to fuel tank 41 across the relief valve poppet 83. This additional rotor rotation and the subsequent bypassing of fuel through the fixed orifice 70 located in the bypass port 65 and the spill passage 76 ends the injection of fuel to the cylinder combustion chamber in the engine.

The additional fuel being delivered from the pumping chamber 20 is directed through the spill passage 76 until rotation of the rotor 42 opens communication of the delivery passage 32 with one of the axial slots 49. The fuel being bypassed to the one axial slot 49 returns to fuel tank 41 through the passageway 36, the conduit 38, and the relief valve 40. As noted from a closer review of FIGS. 2 and 5, the bypass port 65 opens to the spill passage 76 prior to the delivery passage 32 opening to the slot 49. It is recognized that the timing on the rotor 42 could be altered such that the communication of the bypass port 65 with the spill passage 76 and the communication of the delivery passage 32 with the axial slots 49 could occur simultaneously or at various other intervals.

As the rotor 42 rotates further, the communication between the delivery passage 32 and the inlet port 44 is interrupted. Substantially simultaneously the pumping plunger 22 is at the end of the pumping stroke, as illustrated in FIG. 1 at the end of stroke postion 22*b*. At this time interval, the other pumping plunger 20 is in the full fill position 22*c*. As the pumping plunger 20, shown in FIG. 1, retracts towards the full fill position 22*c*, the pumping chamber 20 fills with fuel delivered from the fuel transfer pump 39. As shown in FIG. 1, the fuel from the pump 39 is directed through the conduit 38, the passageway 36, the first annular groove 48, one of the axial slots 49, and the delivery passage 32 to the pumping chamber 20. The relief valve 40 controls the pressure level of the fuel from the pump 39 to approximately 275 kPa (40 psi).

During the filling of the pumping chamber 20, shown in FIG. 1, the other pumping plunger 22 is delivering pressurized fuel to the other delivery passage 33. At the start of this delivery stroke, the delivery passage 33 is in simultaneous communication with one of the inlet ports 44 of the rotor and one of the axial slots 49. Since the one axial slot 49 is in communication with the tank 41 through the relief valve 40, all of the fuel will be bypassing or "spilling" to tank 41 across the one axial slot 49. Even though the fuel in the delivery passage 33 is open to one of the distributor passages 34 through the inlet port 44, the axial passage 43, and the outlet port 45, the fuel takes the path of least resistance which is through the relief valve 40. As the rotor 42 rotates further, the axial slot 49 is blocked from the delivery passage 43. This is the point at which injection of fuel to the cylinder combustion chamber starts. Injection continues until the bypass port 65 opens to the spill passages 77.

Figure 3:
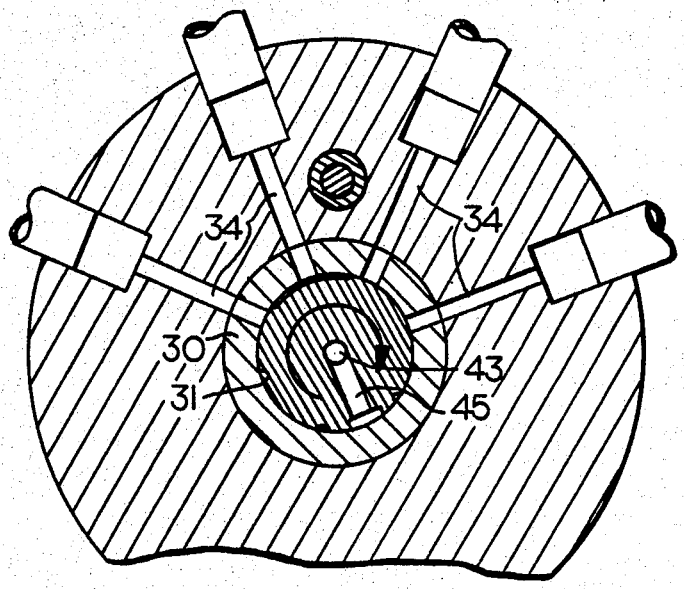
FIG. 3 is a somewhat enlarged view taken along line III—III of FIG. 1.

As illustrated in FIGS. 3 and 4, the subject design is functional for an engine having eight cylinders. Furthermore, it is quite obvious that there are only two pumping plungers 22 in the pumping section 12 and four inlet ports 44 in the rotor 42. Therefore, it is necessary that the drive shaft 23 rotates at a faster rate than the rotor 42. The planetary gear arrangement 16 provides a 4:1 reduction between the rotary speed of the pumping section 12 and the rotor 42. Consequently, each of the plunger assemblies 22 makes four complete pumping strokes to each complete revolution of the rotor 42. Furthermore each of the inlet ports 44 of the rotor 42 receives fluid from both of the respective delivery passage 32,33 during each complete revolution of the rotor 42. In order to achieve the needed 45° arc of rotation for each injection, the delivery passages 32,33 open to the bore 31 at points arcuately spaced 135° apart while the four inlet ports 44 open to the peripheral surface 52 of the rotor 42 evenly spaced 90° apart. The same timing relationship is also needed between the collar 72 and the rotor 42. Consequently the spill passages 76,77 open to the bore 73 at points arcuately spaced 135° apart and the four bypass ports 65 open to the peripheral surface of the rotor 42 evenly spaced 90° apart.

In order to control the start of injection with respect to the engine operation, the postion of the inlet ports 44 of the rotor 42 must be adjusted or timed with respect to the delivery passages 32,33. This is accomplished by controllably rotating the ring gear 89 of the planetary gear arrangement 16. The rotation of the ring gear 89 with respect to the sun gear 91 alters the angular postion of the rotor 42 with respect to the drive shaft 23, thus altering the start of injection. The ring gear 89 is controllably rotated in response to the governor control 100 through the operating mechanism 106, the control shaft 103, and the eccentric projection 104.

The end of injection is controlled by controllably rotating the collar 72 with respect to the rotor 42. The collar 72 is rotated in response to the governor control 100 through the operating mechanism 111, the control shaft 108, and the eccentric projection 109.

The governor control 100 receives an input signal representative of the engine RPM from the flyweight assembly 98. The governor control 100 controllably adjusts the start of injection and the end of injection to provide the needed quantities of fuel to the respective cylinder combustion chambers of the engine.

Hydrostatically balancing the rotor 42 is very important when operating the distribution valve 14 in excess of 55,000 kPa. As best shown in FIG. 7, the pressure fields 56,57 circumscribe the respective outlet ports 45,46. The boundaries of the pressure fields are established by the first and second grooves 59,60. The first and second grooves 59,60 either directly connect with the slots 49 or are connected to the slots 49 by the groove extensions 61.

Each of the pressure fields 56,57 has a size as determined by the diametrical clearance between the bore 31 of the sleeve 30 and the peripheral surface 52 of the rotor 42 with respect to the system operating pressure. It is well established in the art that diametrical clearance be provided between rotating parts. Further, it is recognized that this clearance provides a path for fluid leakage. The larger the clearance, the greater the leakage. In order to maintain efficiency of the fuel distribution valve 14, it is beneficial to maintain minimum clearance.

When considering that the clearance between the rotor 42 and the bore 31 is primarily a finite orifice, it is recognized that the pressure of the fluid near the outlet ports 45,46 is high and decreases to substantially zero at a given distance from the outlet ports 45,46. By interrupting the pressure field 56/57 at a point prior to the pressure decreasing to zero, the force acting on the one side of the peripheral surface 52 is controlled. By controlling the size of the pressure field 56/57 on the other side of the rotor 42 to the same degree, the differential force is held within acceptable limits.

It has been found that when operating the distribution valve 14 at, for example, approximately 100,000 kPa the diametrical clearance between the rotor 42 and the bore 31 is selected from the range of 0.0025 to 0.005 millimeters (100 to 200 microinches).

The grooves 59,60 are large enough to pass the limited amount of leakage fluid to the slots 49 but small enough not to create a sudden pressure drop when one of the distributor passages 34,35 communicate with either of the grooves 59,60.

Since the outlet ports 45,46 are axially offset and open to the peripheral surface 52 on opposite sides, a force couple is established. This force couple subjects the rotor to bending moments. By having the inlet ports 44 closely adjacent the outlet ports 45,46, the effects of the force couple are reduced. To further offset the effects of the force couple, the land 51 is provided. The land 51 provides support to the spool at a location spaced from the force couple to resist bending.

For ease in manufacturing, the grooves 59,60 of the pressure fields are made substantially square. It is recognized that other shapes, such as round, rectangular, etc. can be used without departing from the essence of the invention.

In view of the foregoing, it is readily apparent that the distribution valve shown and described herein provides a hydrostatic balancing arrangement for the rotor 42 to ensure unrestricted rotation even when operating with system pressures in excess of 55,000 kPa. The size of the pressure fields 56,57 controls the differential forces acting on the spool thus eliminating rotor sticking while still maintaining fuel leakage to an acceptable level.

Other aspects, objects and advantages of this invention can be obtained from a study of the drawings, the disclosure and the appended claims.

We claim:

1. In a distribution valve having a housing defining a bore and a plurality of distributor passages in communication with the bore, a rotor located in the bore and adapted to rotate, said rotor having a peripheral surface, an axial passage located therein in selective communication with a source of pressurized fluid, and a pair of outlet ports in continuous communication with the axial passage and opening to the peripheral surface on opposite sides of the rotor and in selective communication with the distributor passages of the valve housing, the improvement comprising:

means for establishing pressure fields of a predetermined size relative to the diametrical clearance between the rotor and bore and the normal operating pressure so that a differential force acting to cause eccentricity of the rotor in the bore is minimized thus eliminating rotor sticking, said pressure fields being disposed on opposite sides of the rotor and each circumscribing the respective one of the pair of outlet ports.

2. The distributor valve as set forth in claim 1, wherein the establishing means includes first and second grooves formed on the periphery of the rotor respectively circumscribing each of the outlet ports and communicating with a low pressure zone.

3. The distributor valve, as set forth in claim 2, wherein the normal operating pressure is above 55,000 kPa.

4. The distributor valve, as set forth in claim 2, wherein said diametrical clearance between the rotor and the bore is selected from the range of 0.0025 to 0.005 millimeters.

5. The distributor valve, as set forth in claim 4, wherein said plurality of distributor passages in the housing intersect the bore in two different axially spaced planes, and each of said outlet ports exit on the peripheral surface of the rotor in axially offset relation to the other and respectively aligned with the two different planes of distributor passages.

6. The distributor valve, as set forth in claim 5, wherein the housing includes a delivery passage connected to said source of pressurized fluid and intersecting said bore axially spaced from the distributor passages, and the rotor includes a plurality of evenly spaced inlet ports opening around the peripheral surface and in communication with the axial passage for selective communication with said delivery passage.

7. The distributor valve, as set forth in claim 6, wherein a plurality of evenly spaced axial slots are respectively located on the peripheral surface of the rotor between the inlet ports, said slots being in communication with said low pressure zone.

8. In a rotor adapted for use in a fuel injection distributor valve, said rotor having a peripheral surface the improvement comprising:

a plurality of inlet ports spaced angularly around the peripheral surface of the rotor;

a plurality of axial slots respectively located around the peripheral surface of the rotor between the inlet ports;

an axial passage defined in the rotor and connected at one end to the plurality of inlet ports;

first and second outlet ports connected to the axial passage and respectively exiting on the peripheral surface of the rotor on opposite sides thereof and axially spaced from the inlet ports; and first and second grooves formed on the peripheral surface of the rotor respectively circumscribing the outlet ports and connected to the axial slots, said first and second grooves being adapted to establish a pressure field of a predetermined size on the peripheral surface to hydrostatically balance the rotor.

9. The rotor, as set forth in claim 8, wherein said outlet ports exit on the peripheral surface of the rotor axially offset from each other.

10. The rotor, as set forth in claim 9, wherein said pressure fields are substantially square in shape, and extension grooves connect the perimeter of one of the pressure fields with the axial slots.

11. The rotor, as set forth in claim 10, wherein said pressure fields each have two sets of parallel sides, one of the sets of parallel sides of each pressure field extend axially on the peripheral surface of the rotor, and the groove extensions of the one pressure field extend axially from the parallel sides to the axial slots.

12. The rotor, as set forth in claim 11, wherein one of the other two parallel sides of one of the pressure fields circumscribing one outlet is located circumferentially around the peripheral surface of the rotor diametrically opposed to the other outlet.

13. The rotor, as set forth in claim 12, wherein an annular groove is defined on the rotor adjacent the plurality of inlet ports and axially spaced on the opposite side of the inlet ports relative to the first and second outlet ports.

14. The rotor, as set forth in claim 13, wherein a second annular groove is defined on the rotor axially spaced further from the inlet ports than the first annular groove and adapted to define a land on the rotor between the first and second annular grooves.

* * * * *